US005762655A

United States Patent [19]

Kief

[11] Patent Number: 5,762,655

[45] Date of Patent: Jun. 9, 1998

[54] FUEL FOR INTERNAL COMBUSTION ENGINES AND TURBINES CONTAINING OZONIZATION PRODUCTS

[76] Inventor: Horst Kief, Londoner Ring 105, D-67069 Ludwigshafen, Germany

[21] Appl. No.: 578,717

[22] PCT Filed: Jun. 23, 1994

[86] PCT No.: PCT/EP94/02052

§ 371 Date: Apr. 26, 1996

§ 102(e) Date: Apr. 26, 1996

[87] PCT Pub. No.: WO95/01411

PCT Pub. Date: Jan. 12, 1995

[30] Foreign Application Priority Data

Jun. 30, 1993 [DE] Germany ..... 43 21 808.3

[51] Int. Cl.[6] ..... C10L 1/18; C10L 1/08; C10L 1/06

[52] U.S. Cl. ..... 44/309

[58] Field of Search ..... 44/309

[56] References Cited

U.S. PATENT DOCUMENTS

| | | | |
|---|---|---|---|
| 1,885,190 | 11/1932 | Egloff | 44/9 |
| 1,973,475 | 9/1934 | Ellis | 44/9 |
| 2,100,287 | 11/1937 | Conquest | 44/9 |
| 2,132,968 | 10/1938 | Penniman | 44/309 |
| 2,317,968 | 4/1943 | Schultz et al. | 44/309 |
| 2,430,864 | 11/1947 | Farkas et al. | 44/309 |
| 2,912,313 | 11/1959 | Hinkamp et al. | 44/57 |
| 3,009,962 | 11/1961 | Milas | 260/610 |
| 3,960,683 | 6/1976 | Baba | 204/158 R |
| 4,370,223 | 1/1983 | Bose | 208/125 |
| 4,428,828 | 1/1984 | Bose | 208/208 |
| 4,494,961 | 1/1985 | Venkat et al. | 44/309 |
| 4,753,661 | 6/1988 | Nelson et al. | 44/309 |
| 4,946,578 | 8/1990 | Clough et al. | 44/309 |

FOREIGN PATENT DOCUMENTS

| | | | |
|---|---|---|---|
| A-376644 | 11/1931 | Belgium . | |
| 0 095 975 B1 | 10/1985 | European Pat. Off. | C10L 1/22 |
| A-236021 | 9/1987 | European Pat. Off. | C10G 53/10 |
| A-705958 | 6/1931 | France | 14/4 |
| PS 324 294 | 8/1920 | Germany | 46/11 |
| PS 448 620 | 8/1927 | Germany . | |
| PS 455 525 | 2/1928 | Germany . | |
| PS 486 609 | 11/1929 | Germany . | |
| PS 505 928 | 8/1930 | Germany . | |
| PS 553 943 | 12/1932 | Germany . | |
| PS 582 718 | 8/1933 | Germany . | |
| PS 612 073 | 4/1935 | Germany . | |
| PS 699 723 | 12/1940 | Germany . | |
| PS 703 030 | 2/1941 | Germany . | |
| PS 801 865 | 1/1951 | Germany . | |
| PS 843 328 | 7/1952 | Germany . | |
| PS 845 286 | 7/1952 | Germany . | |
| AS 1 221 488 | 7/1966 | Germany . | |
| PS 19 37 000 | 1/1970 | Germany | C10L 1/32 |
| 5-0017402 | 2/1975 | Japan . | |
| 50-017402 | 2/1975 | Japan . | |
| 2091758 | 8/1982 | United Kingdom . | |
| 2262942 | 7/1993 | United Kingdom . | |

*Primary Examiner*—Jerry D. Johnson
*Attorney, Agent, or Firm*—Cammarata & Grandinetti

[57] ABSTRACT

The invention is a fuel and a method for producing an improved hydrocarbon fuel for internal combustion engines and turbines. The method includes the steps of subjecting a conventional hydrocarbon liquid fuel to ozonization. The ozonization is performed under one of two conditions. The first of the two conditions is a process of forming a current of the liquid fuel and bubbling an ozone-oxygen mixture in a countercurrent through the liquid fuel. The second of the two conditions is a process of enriching the liquid fuel with oxygen and subjecting the enriched fuel with ultraviolet radiation. Desirable concentrations of ozonization products in the fuel are from 0.1% o to 2.0% o.

8 Claims, 2 Drawing Sheets

| CLOCK TIME | HC |
|---|---|
| 10.55 | 39 |
| 11.01 | 40 |
| 13.15 | 155 |
| 13.16 | 8 |
| 13.20 | 6 |
| 13.31 | 5 |
| 14.01 | 5 |
| 14.02 | 2 |
| 14.03 | 1 |
| 14.05 | 0 |

| CLOCK TIME | CO |
|---|---|
| 10.55 | 0.13 |
| 11.01 | 0.13 |
| 13.15 | 0.04 |
| 13.16 | 0 |
| 13.20 | 0 |
| 13.31 | 0 |
| 14.01 | 0 |
| 14.02 | 0 |
| 14.03 | 0 |
| 14.05 | 0 |

| CLOCK TIME | 02 |
|---|---|
| 10.55 | 0.05 |
| 11.01 | 0.06 |
| 13.15 | 0.01 |
| 13.16 | 0.23 |
| 13.20 | 0.11 |
| 13.31 | 0.03 |
| 14.01 | 0.13 |
| 14.02 | 0.13 |
| 14.03 | 0.16 |
| 14.05 | 0.06 |

| CLOCK TIME | LAMBDA |
|---|---|
| 10.55 | 0.998 |
| 11.01 | 0.997 |
| 13.15 | 0.993 |
| 13.16 | 1.01 |
| 13.20 | 1.005 |
| 13.31 | 1.001 |
| 14.01 | 1.006 |
| 14.02 | 1.006 |
| 14.03 | 1.007 |
| 14.05 | 1.003 |

| CLOCK TIME | CO2 |
|---|---|
| 10.55 | 17.39 |
| 11.01 | 17.42 |
| 13.15 | 15.12 |
| 13.16 | 15.03 |
| 13.20 | 15.1 |
| 13.31 | 15.23 |
| 14.01 | 15.3 |
| 14.02 | 15.33 |
| 14.03 | 15.31 |
| 14.05 | 15.35 |

FUEL FOR INTERNAL COMBUSTION ENGINES AND TURBINES CONTAINING OZONIZATION PRODUCTS

BACKGROUND OF THE INVENTION

1. Field of the Invention

The present invention concerns a fuel for internal combustion engines; based on hydrocarbons and additives, and a method of production of a fuel by oxidation.

2. Description of Related Art

The amelioration of fuel qualities by addition of diverse substances is a familiar technique. Thus, e.g., according to DE-PS 582 718, heavy metal salts, namely, copper, nickel, cobalt, zinc, and chromium salts, the condensation products of amines with compounds which contain one or more oxygen groups in addition to a carbonyl group, are added to the fuel in order to improve its knock resistance. In DE-PS 448 620 and DE-PS 455 525, fuels are described which have a content of iron carbonyl or nickel, cobalt and/or molybdenum carbonyl. However, this application has not become popular, because the use of metal carbonyls causes a metal oxide deposit in the combustion chambers. According to DE-PS 801 865, the fuel additives can be toluene, benzene, acetone, trichlorethylene or isobutyl alcohol, besides the metal carbonyls, although the fundamental drawback of metal oxide deposits in the combustion chamber remains the same. DE-AS 1 221 488 describes fuel additives consisting of methylcyclopentadienyl manganese tricarbonyl, lead tetraethyl or other organometallic compounds and organic compounds having two ester groups. Furthermore, the following organic fuel additives are part of the state of the art: a mixture of an aromatic amine and a polyalkyl phenol is known from DE-PS 845 286; tetraarylhydrazine, diarylnitrosamine and triarylmethyl derivates from DE-PS 505 928; aldehydes, quinones and ketones from DE-PS 612 073; ketones of formula R—CO—R', wherein R represents a ring radical and R' an aliphatic radical with at least 6 C-atoms, from U.S. Pat. No. 2,100,287; hydroquinone in a benzene solution from DE-PS 486 609; ether derivates from DE-PS 703 030; alcohols from DE-PS 843 328; condensation products of alkylene oxides and alkylphenols from DE-PS 19 37 000; anthracene derivates from U.S. Pat. No. 1,885,190 and 1,4-dialkyl-arylamino-anthraquinone from EP 09 095 975 B1. U.S. Pat. No. 1,973,475 describes a method for oxidation of fuels with air or oxygen at elevated temperatures, possible in the presence of a catalyst. DE-PS 699 273 discloses a method of dehydrogenation of nonflammable oils from the boiling range of diesel oils in inflammable oils with oxidizing agents such as air or oxygen, ozone, peroxides, chromic acid or nitric acid at 150°–350° C., possibly at elevated pressure and preferably in presence of a catalyst. The ozonization of fuels is also described in DE-PS 324 294 and DE-PS 553 943. According to DE-PS 324 294, ozonizides such as ethylene ozonide, or a mixture of one of the conventional fuels with an ozonide, are added to the internal combustion engine. The drawback of the method is the instability of the ozonides, so that when kept for a lengthy time the availability of oxygen carriers is necessarily variable, apart from the problems of environmental pollution, which were not known at the time. According to DE-PS 553 943, a mixture of hydrocarbons is ozonized under pressure in the presence of an oxygen carrier, such as nitrobenzene, or an oxygen transfer agent, such as turpentine oil, and slight amounts of ignition-promoting substances.

SUMMARY OF THE INVENTION

The purpose of the present invention is to reduce the emission of pollutants and the consumption of fossil fuels and their derivates. The pollution of the environment by the incomplete combustion sequence in detonation engines with expulsion of carbon monoxide, unburned hydrocarbons, as well as nitrogen oxide is sufficiently well known. Subsequent catalytic combustion by metal-ceramic catalysts is really only a stopgap measure, because an afterburning basically means the loss of these energy suppliers from the primary energy production process. Therefore, preference should be given to an optimization of the combustion process in the immediate energy-supplying step.

The present invention accomplishes this purpose in a fundamental, technically sensible and effective mode and manner.

DESCRIPTION OF THE PREFERRED EMBODIMENT

According to the invention, the fuel for internal combustion engines and turbines that is based on hydrocarbons and additives contains a sufficient quantity of ozonization products, wherein a conventional hydrocarbon-containing fuel is ozonized in familiar manner or a slight amount of the ozonized fuel is added to untreated fuel.

In a preferred embodiment of the present invention the ozonization occurs through countercurrent treatment.

Preferably, the content of ozonization products is 0.2 to 2.5% o.

With special preference, the content of ozonization products is 1% o.

A further objective of the present invention is a method for production of a fuel by oxidation, wherein the hydrocarbon-containing fuel is ozonized in familiar manner.

In a preferred embodiment of this process, an ozone-oxygen mixture is used.

In an especially preferred embodiment of this method, the ozonization is carried out by the countercurrent method, and the ozone-oxygen mixture is bubbled through the liquid fuel.

In an especially preferred embodiment, the ozonization is carried out by the circulation method, wherein the ozone-oxygen mixture is bubbled repeatedly through the fuel in countercurrent.

In an especially preferred embodiment, the fuel is first enriched with oxygen and then subjected to ultraviolet radiation.

Figure 1:
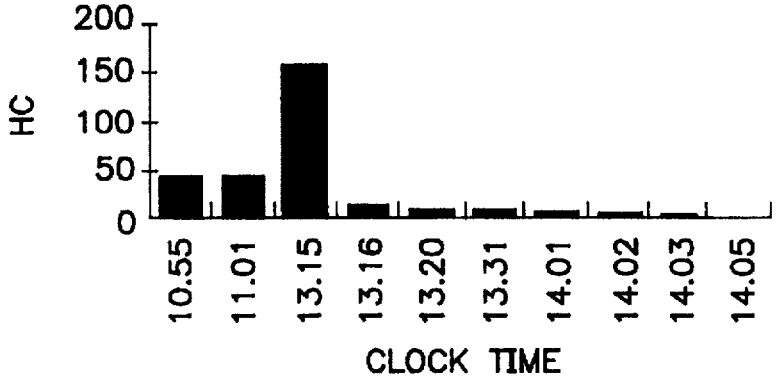
FIG. 1 is a graph of HC reduction under additive 0.022%.

FIGS. 1 through 5 graphically present the pollution emission values of a stationary engine (Porsche 944 KAT) that is operated with a fuel containing 0.022% of the ozonized fuel according to the invention. FIG. 1 shows the hydrocarbon values (g), FIG. 2 the carbon monoxide values (g), FIG. 3 the oxygen values, FIG. 4 the lambda values, and FIG. 5 the carbon dioxide values (g), each being measured after particular intervals of time.

The ozone used in the method according to the invention can be generated in advance, e.g., by a dark discharge, and then be blown into the fuel, or generated by blowing of oxygen and air and subsequent ultraviolet irradiation. According to the invention, gasoline, kerosene or diesel fuels can be used as the fuel. The replacement of lead tetraethyl with benzene, mandated by lawmakers, has the disadvantage that benzene is cancer-causing. The oxidation of the benzene as promoted by the invented method reduces this hazard considerably. The method has the further advantage that the improved combustion breaks down more residues on valves and in the combustion chamber and thereby achieves a certain cleaning effect. The method according to the invention is preferably carried out with pure oxygen or with air which has an increased oxygen proportion, since the catalytic action of metal surfaces results in nitrogen oxides which reduce the effectiveness of the technique. It is therefore advantageous to boost the oxygen component of the reaction by molecular filter prior to the generation of ozone. One clear way to increase the proportion of the oxidized reaction products is by lengthening the contamination time of the ozone-oxygen mixture with the fuel. If this is done by the countercurrent method, the yield can be significantly increased. The countercurrent method has the further advantage that the bubbling of the fuel column with the ozone-oxygen mixture prevents local ozone concentrations and, therefore, self-ignition of the fuel, thanks to the continuity of the countercurrent fuel-gas flow.

Comparison measurements were carried out on a passenger car with Otto motor, the fuel of which contained a 0.25% additive of the invented fuel or no such additive.

TABLE 1

| Result (gram/test) | HC | CO | $NO_z$ |
|---|---|---|---|
| No additive: | 8.309 | 32.633 | 4.705 |
| With additive: | 6.699 | 28.357 | 4.871 |

As is evident from Table 1, the nitrogen oxide component according to the ECE Standard (city-driving cycle) is increased by only 3–4%, while at the same time reducing the emission of pollution HC and CO by roughly 16–20%.

TABLE 2

| Result (%) | CO (measured while idling) |
|---|---|
| No additive: | 0.4–0.5 |
| With additive: | 0.15 |

It is evident from Table 2 that the emission of CO while idling is reduced around 67% by using an additive according to the invention. A further series of tests revealed that an additive of such ozonization products of the fuel of approximately one per thousand to the untreated fuel produces a reduction of pollution emissions while idling of around 85%, measured in terms of CO and HC.

The frequently untrue running of modern lean engines is balanced out almost like a turbine. After adding such an additive, there occurs an increased expulsion of HC in the short term, being the result of increased breakdown of combustion residues. The use of such an ozonized fuel additive therefore has not only the advantage of less emission of pollutants, but also enhanced knock resistance of the fuel, as has already been described in DE-PS 324 294 and DE-PS 553 943. A further advantage is that it is itself burned as organic material, so that there need be no debate about possible contamination of the environment with heavy metals such as palladium and platinum.

Metal-ceramic catalysts in the exhaust section of vehicles lose their effectiveness after a certain time of use, due to impurities. With the fuel prepared according to the invented method, it has been established in several series of tests that rather old catalysts after using such treated fuel again regain their original effectiveness and keep this for months, even though prepared fuels are no longer used after the additive is employed once or twice in the described manner.

Figure 2:
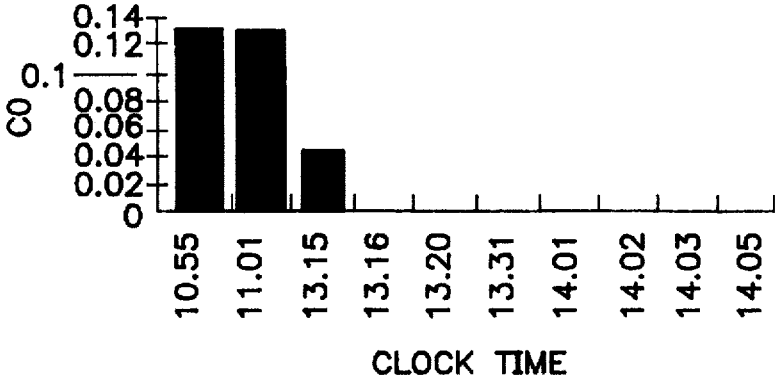
FIG. 2 is a graph of CO reduction under additive 0.022%.
Figure 3:
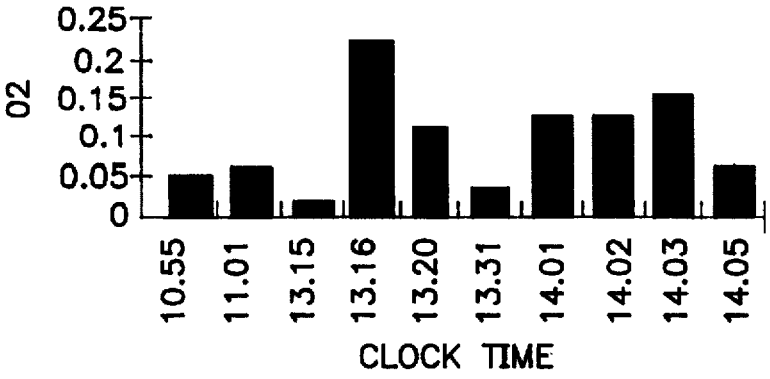
FIG. 3 is a graph of $O_2$ reduction in the exhaust under additive 0.022%.
Figure 4:
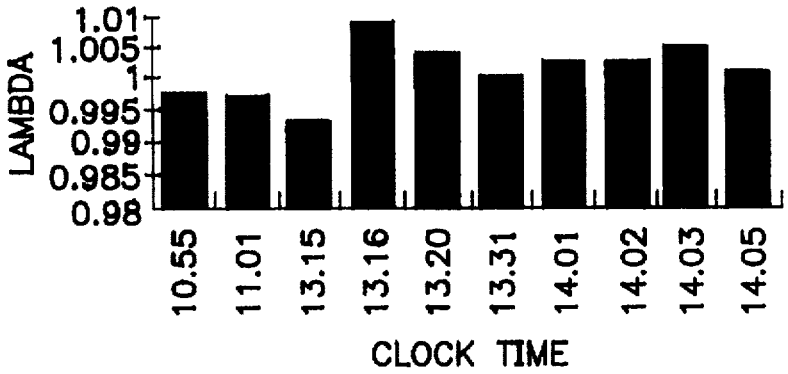
FIG. 4 is a graph of the change of lambda under additive 0.022%.
Figure 5:
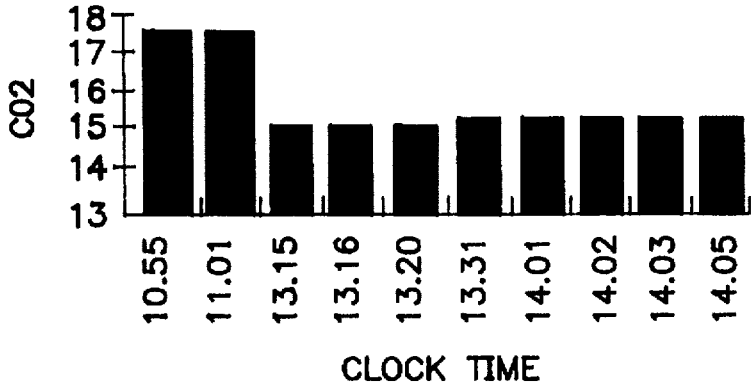
FIG. 5 is a graph of $CO_2$ in the exhaust under additive 0.022%.

Exhaust gases of engines which are operated with such prepared fuel show an increased proportion of $O_2$ in the exhaust, which is also responsible for the intensified cleaning effect on oxidation catalysts. Even vehicles which are outfitted with a regulated, but overaged catalyst, again reach values of 0 HC and 0 CO in the exhaust after a brief running time (FIG. 1 and FIG. 2).

This accelerated oxidation process is also responsible for elimination of combustion residues (so-called "coking") in the combustion space and on the valve seats, as was found during the series of tests conducted.

The following example should illustrate the production of the invented fuel:

Lead-free normal gasoline was placed in a glass column 40 cm long, into which an $O_2$–$O_3$ mixture with 80 μg $O_3$ per ml $O_2$ was blown in from the bottom through a diffuser at a speed of 1 liter per minute. The gasoline was pumped out at the bottom through a second drainage pipe and added again at the top, so that a circulation was created.

I claim:

1. A method for producing an improved hydrocarbon fuel for internal combustion engines and turbines consisting essentially of:

selecting a liquid hydrocarbon fuel from the group consisting of gasoline, kerosene, and diesel fuels;

subjecting said liquid hydrocarbon fuel to ozonization to provide a concentration from 0.2 to 2.5% o of ozonization products, said ozonization being performed under one of two conditions, said conditions being:

(i) forming a current of said liquid hydrocarbon fuel and bubbling a mixture consisting of ozone and oxygen in a countercurrent through said liquid hydrocarbon fuel; and (ii) enriching said liquid hydrocarbon fuel with oxygen and subjecting said enriched fuel to ultraviolet radiation.

2. The method of claim 1 wherein said ozonization is performed by bubbling said mixture consisting of ozone and oxygen through said liquid hydrocarbon fuel, said mixture consisting of ozone and oxygen being bubbled by repeated countercurrents through said current of liquid hydrocarbon fuel.

3. The method of claim 1 wherein said ozonization of said liquid hydrocarbon fuel provides a concentration of 1% o of ozonization products.

4. The method of claim 1 wherein said liquid hydrocarbon fuel contains benzene.

5. An improved fuel for internal combustion engines and turbines comprising:

a liquid hydrocarbon fuel selected from the group consisting of gasoline, kerosene, and diesel fuels; and ozonization products, said ozonization products being in a concentration of 0.2% o to 2.5% o.

6. The fuel of claim 5 wherein said concentration of said ozonization products is 1.0% o.

7. An improved fuel for internal combustion engines and turbines consisting essentially of:

a liquid hydrocarbon fuel selected from the group consisting of gasoline, kerosene, and diesel fuels;

ozonization products, said ozonization products being in a concentration of 0.2% o to 2.5% o; and benzene.

8. The fuel of claim 7 wherein said concentration of said ozonization products is 1.0% o.

* * * * *